US005546720A

United States Patent [19]

LaBruzza

[11] Patent Number: 5,546,720

[45] Date of Patent: Aug. 20, 1996

[54] PANEL ASSEMBLY SYSTEM

[75] Inventor: Gabriel M. LaBruzza, Beaverton, Oreg.

[73] Assignee: Color & Design Exhibits, Beaverton, Oreg.

[21] Appl. No.: 402,484

[22] Filed: Mar. 10, 1995

[51] Int. Cl.[6] ..... E04B 2/00

[52] U.S. Cl. ..... 52/587.1; 52/586.2

[58] Field of Search ..... 52/584.1, 586.2, 52/586.1, 587.1, 582.1, 581, 578; 160/135, 351; 403/339, 340, 363

[56] References Cited

U.S. PATENT DOCUMENTS

| | | | |
|---|---|---|---|
| Re. 34,738 | 9/1994 | Brady . | |
| 3,332,192 | 7/1967 | Kessler et al. | 52/586.1 X |
| 3,589,755 | 6/1971 | King | 52/584.1 |
| 4,437,275 | 3/1984 | Zeigler . | |
| 4,462,196 | 7/1984 | Freiberg | 52/586.1 |
| 4,471,548 | 9/1984 | Goudie . | |
| 4,512,097 | 4/1985 | Zeigler . | |
| 4,610,560 | 9/1986 | Miller . | |
| 4,712,336 | 12/1987 | Backer . | |
| 4,823,858 | 4/1989 | Perutz . | |
| 4,967,531 | 11/1990 | Giles et al. | 52/587.1 |
| 5,097,643 | 3/1992 | Wittler | 52/587.1 X |
| 5,295,341 | 3/1994 | Kajiwara | 52/586.2 |
| 5,325,649 | 7/1994 | Kajiwara | 52/586.1 |

*Primary Examiner*—Lanna Mai
*Attorney, Agent, or Firm*—Kolisch, Hartwell, Dickinson, McCormack & Heuser

[57] ABSTRACT

A panel system is provided in which adjacent panels are removably joined at their edges. The system includes the following components: a pair of substantially identical clips, each of which is affixed to an edge of a panel, each clip including a base portion and a body portion extending upwardly from the base portion in a generally perpendicular disposition with respect to the base portion. At least two linear members extend in an inward direction away from the body portion away from the base. These members define slots which also extend parallel to the base. These body further includes a substantially flat, outwardly facing portion on the side of the body opposite the members. Each of the panel edges defines a channel having flat walls which extend parallel to their respective panel. The channel walls extend from a channel bottom upwardly to the panel edge.

The base of each clip is designed to be affixed to its respective channel at the bottom. The configuration and height of the clips are such that at least one of the linear members and at least one of the slots is disposed within the channel when the base is mounted in place, and at least one of the linear members and at least one of the slots extends out of the channel beyond or above the edge of the panel. The flat, outwardly facing portion of the body of each clip extends in substantial contact with its adjacent channel wall when the clip is affixed in the channel.

The clips and their associated panels can be mounted to one another by sliding the linear members of one of the clips into complementary slots in the other clips, with the channel walls preventing the two clips from being disengaged. Once it is desired to disassemble the panels they are vertically slid apart. Because the normal loading of a panel is not normally in that lengthwise direction, inadvertent dislodgement is highly unlikely.

7 Claims, 6 Drawing Sheets

PANEL ASSEMBLY SYSTEM

BACKGROUND OF THE INVENTION

This invention relates to a system for removably assembling a plurality of panels. More specifically the invention relates to a clip design which is mounted into the facing edges of a pair of panels, and which may be interengaged to hold the panels together.

Many situations arise in which panels must be removably mounted to one another to present a continuous display surface. Such displays may be used in reception areas, or at trade shows, museums, art exhibits, or any other setting where visual information is displayed. It is often desirable that these panel systems be disassemblable because the size and shape of the display may need changing, or the display may need to be transported from one place to another. Many such display systems are found in the prior art, such as those disclosed in U.S. Pat. Nos. 4,512,097 and 4,437,275 to Zeigler, and 4,471,548 to Goudie. Other systems are disclosed in U.S. Pat. Nos. 4,712,336 to Backer, 4,610,560 to Miller, and 4,823,858 to Perutz.

Another prior art system disclosed in U.S. Pat. No. Re. 34,738 to Brady. That patent discloses a clip system which permits the removable mounting of flat display panels. The clip system of that patent is relatively lightweight and inexpensive, and permits the panels to be mounted to create a so-called full bleed display surface which provides a continuous display surface, without gaps between adjacent panels. That system can be assembled without tools and by one with little skill.

However, there are several problems with the Brady system. An intricate and therefore relatively expensive aluminum extrusion is utilized at the edges of each of the panels to be assembled, due to the configuration of the mounting clips. When assembled together, these channels include, in cross section, an edge extrusion which is generally hourglass-like. Each of the clips includes a pair of flexible, semi-circular tubes which are designed to resiliently conform to the configuration of the hourglass channel to form a suitable mounting structure. This tube configuration is relatively difficult and therefore relatively expensive to mold, and because of the resiliency requirement they can become misshapen over time. This can result in the panels becoming misaligned with respect to one another, or can present problems in subsequent assembly.

It is an object of the present invention to overcome the drawbacks and limitations of the prior art proposals. More specifically, the invention has as its objects:

1) to provide a panel assembly system which is easy to assemble, and which permits assembly by one with little skill or training;

2) to develop a panel assembly system which is inexpensive to fabricate and use;

3) the provision of a panel assembly system which holds panels in place while they are being positioned and otherwise manipulated;

4) to provide a panel assembly clip which is designed to hold adjacent panel edges in place for an extended period of time without warping or becoming disfigured in such a way that will cause the panels to sag or become misaligned with respect to one another;

5) to develop a clip mounting system for panels which is easy to mold or extrude and which does not have to be structurally strong or require the use of complex and therefore expensive panel edge extrusions; and 6) the provision of a panel assembly system which is self-centering and which therefore automatically aligns adjacent panels as they are being assembled.

SUMMARY OF THE INVENTION

The above objects are best achieved by providing a panel system in which adjacent panels are removably joined at their edges, and which includes a pair of substantially identical clips, each of which is affixed to an edge of a panel. Each clip includes a base portion and a body portion extending upwardly from the base portion in a generally perpendicular direction. At least two linear members extend in an inward direction away from the body portion, and parallel to the base. These members define at least two slots therebetween which also extend parallel to the base. The body further includes a substantially flat, outwardly facing portion on the side of the body opposite the members. Each of the panel edges defines a channel having flat walls which extend parallel to their respective panel. The channel walls extend from a channel bottom upwardly to the panel edge.

The base of each clip is designed to be affixed to its respective channel at the bottom thereof. The configuration and height of the clips are such that at least one of the linear members and at least one of the slots is disposed within the channel when the base is mounted in place, and at least one of the linear members and at least one of the slots extends out of the channel beyond or above the edge of the panel. The flat, outwardly facing portion of the body of each clip extends in substantial contact with its adjacent channel wall when the clip is affixed in the channel.

The clips and their associated panels can be mounted to one another by sliding the linear members of one of the clips into complementary slots in the other clips, with the channel walls preventing the two clips from being disengaged. Once it is desired to disassemble the panels, they can be vertically slid apart. Because the loading of a panel is not normally in that vertical direction, inadvertent dislodgement is highly unlikely.

Another aspect of the invention can be described as a clip which is designed for removable assembly of a pair of panels. The clip is generally as described above.

These and other objects and advantages of the present invention will become more fully apparent as the description which follows is read with reference to the drawings.

DETAILED DESCRIPTION OF THE DEPICTED EMBODIMENT

Figure 1:
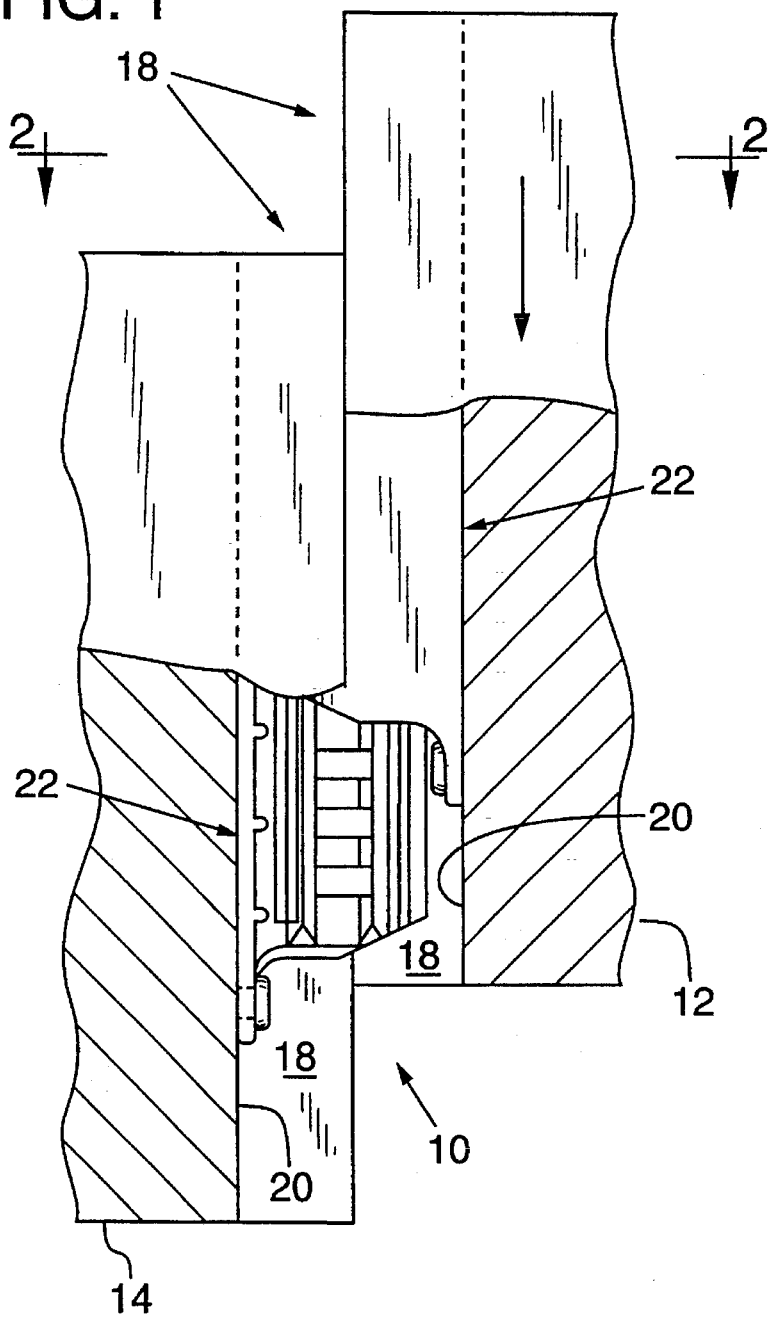
FIG. 1 is a front elevation view of adjacent panels being assembled using the clip of a first embodiment, with a portion of the panels being broken away to expose the clips.
Figure 2:
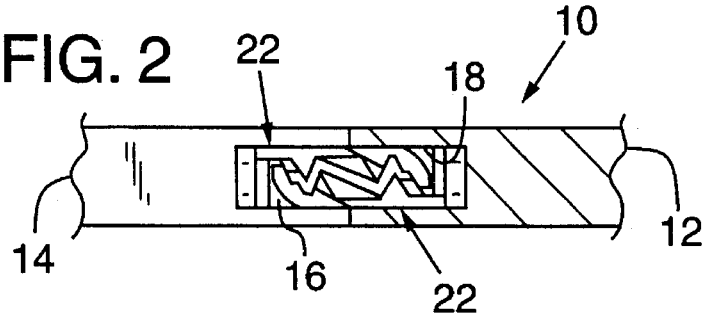
FIG. 2 is a partially sectional view taken along line 2—2 of FIG. 1, showing, in end elevation, the nested clips.
Figure 3:
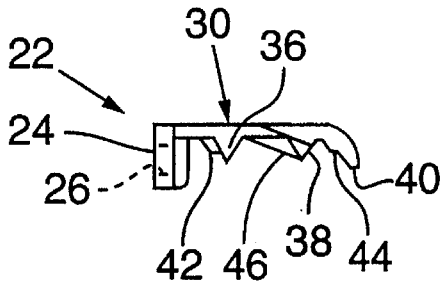
FIG. 3 is an end elevation view of the clip of the first embodiment.
Figure 4:
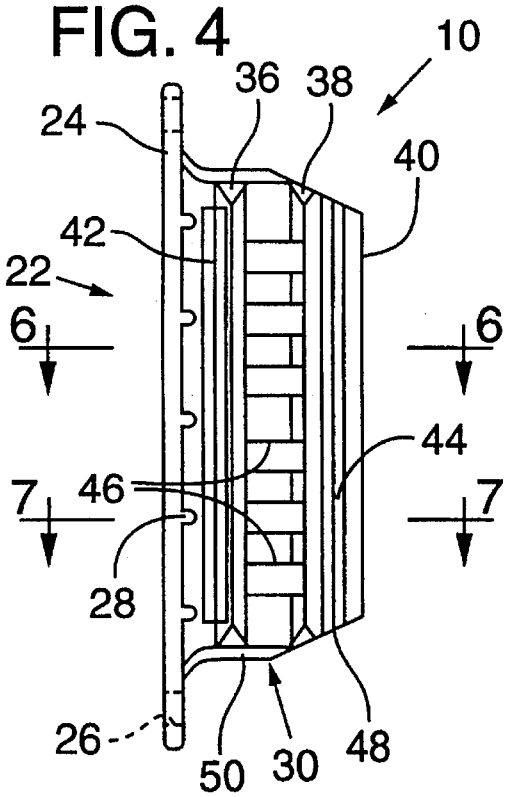
FIG. 4 is a front elevation view of the clip of the first embodiment showing the inward facing side of the body portion of the clip.

Turning now to the drawings, and initially to FIGS. 1 and 2, the panel assembly system of the depicted embodiment of the present invention is shown generally at 10. First and second panels can be seen in part and are identified at 12 and 14, respectively. As noted above, the system is designed to utilize a simple channel configuration at the edges of each of the panels 12 and 14. This system incorporates the generally U-shaped channel 16 (see FIG. 2) which includes parallel walls 18 and a channel bottom 20 which extends in the direction perpendicular to the channel walls. As used herein the term "upwardly" will refer to a direction axially away from the edge of the panels, so it can be seen that channel walls 18 extend upwardly although in actuality they will be extending laterally toward the adjacent panel. As shown in FIG. 2, a pair of identical clips are shown generally at 22, with each of the clips disposed within its respective channel 16. Referring now to FIGS. 3 through 9, each clip 22 includes a flat base portion 24 which extends the length of the clip and permits the clip to be securely affixed to bottom 20 of channel 16. In the depicted embodiment the system of affixation is a pair of screws 27 (see FIG. 1) which extend through a pair of holes 26 to securely affix each of the clips to its respective panel. The base portion typically includes a plurality of spaced strengthening ribs 28 which provide additional stiffening to the clip.

A body portion 30 extends upwardly from base portion 24, and includes what will be called an inward side 32 and outward side 34. The outward side extends in a substantially perpendicular direction from base portion 24, as does inward facing side 32, although the inward facing side includes additional structure. This additional structure is in the form of at least two linear members which extend in an inward direction away from body portion 30 and parallel to base portion 24. In the depicted embodiment two of these linear members are generally triangular in cross section, and are identified at 36 and 38. This substantially triangular configuration has been found to be beneficial because it is easy to mold and because it renders the unit self-aligning as the two panels are being slid into place. Alternatively, the members can be of rounded configuration. Thus, if in sliding the members together, the linear members from the two clips come into edge abutment, the triangular or rounded configuration will cause one to slide off of the other and thereby move the clips and their panels into proper alignment to permit assembly. In the depicted embodiment, a third linear member is in a form of a generally upwardly and inwardly extending flange 40. As shown best in FIGS. 3, 6 and 7, lower linear member 36, upper linear member 38 and flange 40 define between them three slots, which will be referred to as upper slot 37, lower slot 39 and base slot 41.

In the depicted embodiment, lower substantially triangular linear member 36, or that member which is most proximate the base portion, includes a raised portion 42 which generally faces the base portion. A corresponding cut-out 44 is included in flange 40 so that when the clips are nesting into one another during assembly, raised portion 42 will neatly slide into cut-out portion 44 (see FIG. 2).

Figure 5:
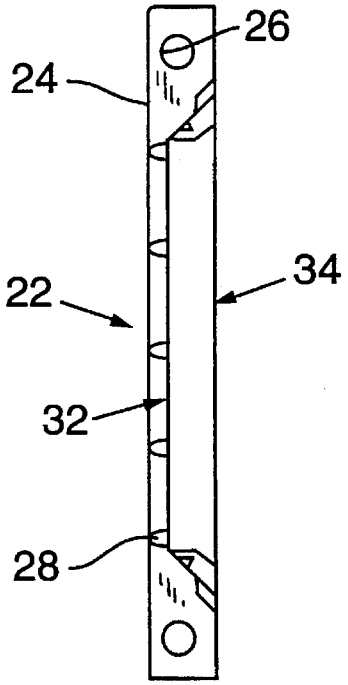
FIG. 5 is a top plan view of the clip of the first embodiment.
Figure 6:
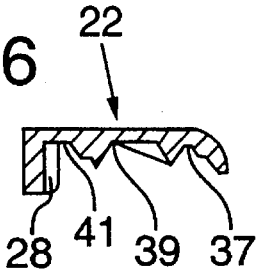
FIG. 6 is an end elevation sectional view taken along line 6—6 of FIG. 4.
Figure 7:
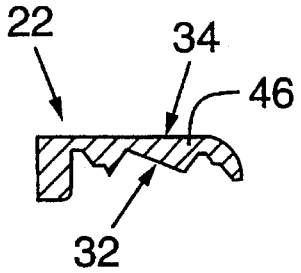
FIG. 7 is an end elevation sectional view taken along line 7—7 of FIG. 4.
Figure 8:
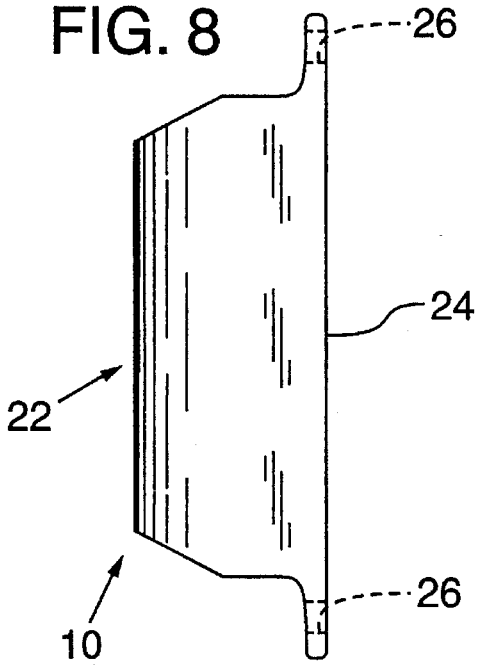
FIG. 8 is a rear elevation view of the clip of the first embodiment, showing the outward facing side of the body portion of the clip.
Figure 9:
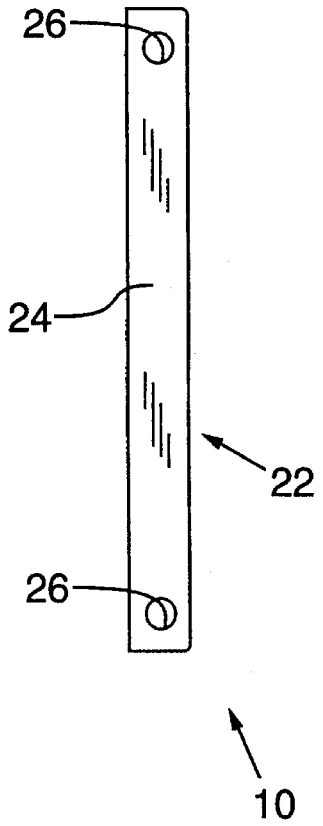
FIG. 9 is a bottom view of the clip of the first embodiment.
Figure 10:
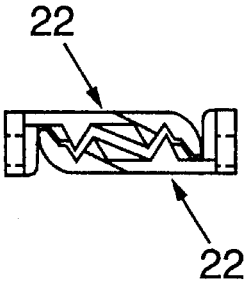
FIG. 10 is an end elevation view showing the clips of the first embodiment in a fully nested disposition.
Figure 11:
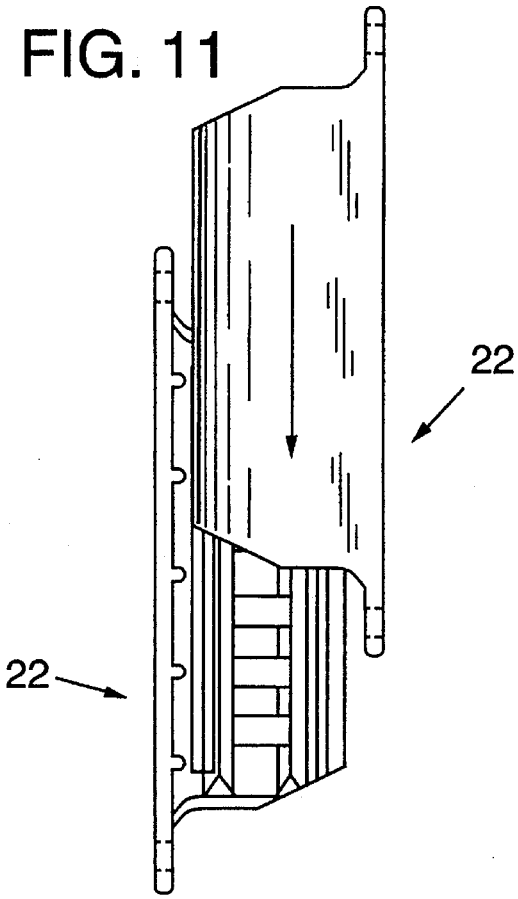
FIG. 11 is a front elevation view showing one clip being slid into an engaged or nested arrangement with the other clip.
Figure 12:
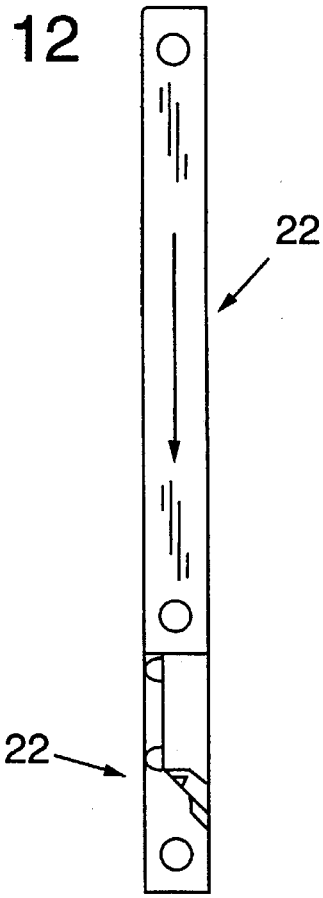
FIG. 12 is a top plan view of the two clips of the first embodiment corresponding to FIG. 11.
Figure 13:
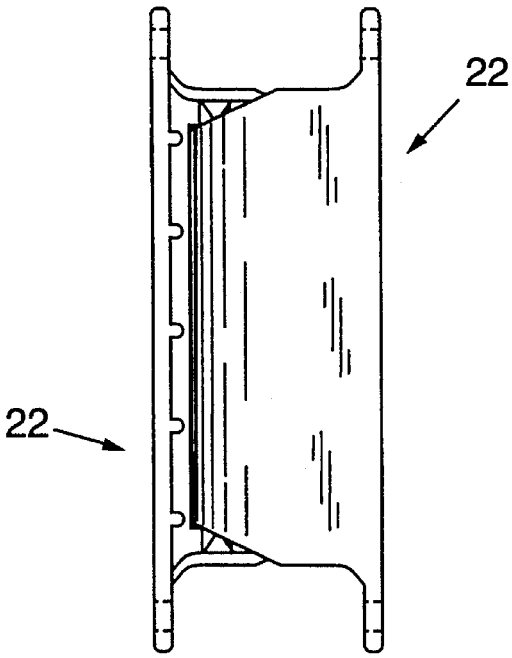
FIG. 13 is a front elevation view showing the two clips in a fully nested disposition.

A plurality of spaced strengthening webs 46 extend angularly from the apex of the upper substantially triangular linear member 38, or that member which is most remote from base portion 24. The strengthening webs extend angularly down to the base of the lower substantially triangular linear member 36, as shown in FIGS. 5 and 6. Strengthening webs 46 are evenly spaced through most of the length of clips 22, as shown best in FIG. 4, in order to permit the clips to be of light construction and yet be sufficiently strong.

As shown in the front and rear elevation views (FIGS. 4, 8, 11 and 13) clips 22 are beveled at their upper portions as shown at 48. Each of the sides of the clips is also chamfered as shown at 50 in FIG. 4 so that the self-aligning capability which is provided by the triangular configuration of linear members of 36 and 38 is further facilitated.

The configuration of clips 22 within their respective channel 16 can be best seen in FIGS. 1 and 2. If attention is directed to each half of the structure, that is, one of the panels 12 or 14 and its channel 16 and clip 22, it can be seen that each clip extends upwardly such that somewhat less than half of its length extends above the panel edge and somewhat more than half is disposed below, within the channel. In the depicted configuration, lower triangular linear member 36 is disposed within the channel, and upper triangular linear 38 and flange 40 are disposed above the edge of the panel outside of the channel. As best seen in FIG. 2, when the clips are fully nested and the panels are thus joined, outward facing side 34 of clips 22 extend along walls 18, in substantial contact therewith.

Figure 14:
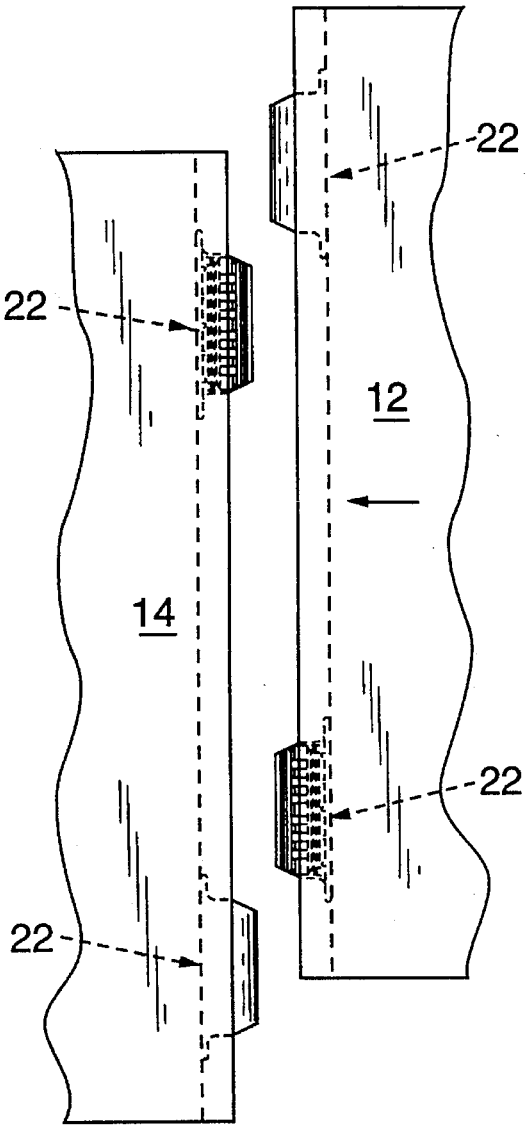
FIG. 14 is a front elevation view showing the panels as they are being moved into position to be engaged with each other.
Figure 15:
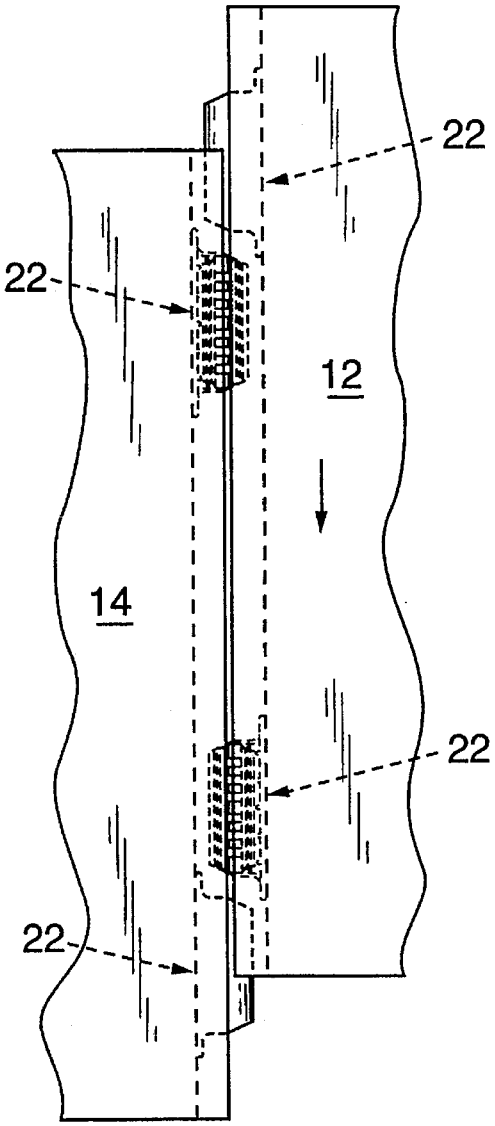
FIG. 15 is a front elevation view showing the panels as they are being slid into engagement.
Figure 16:
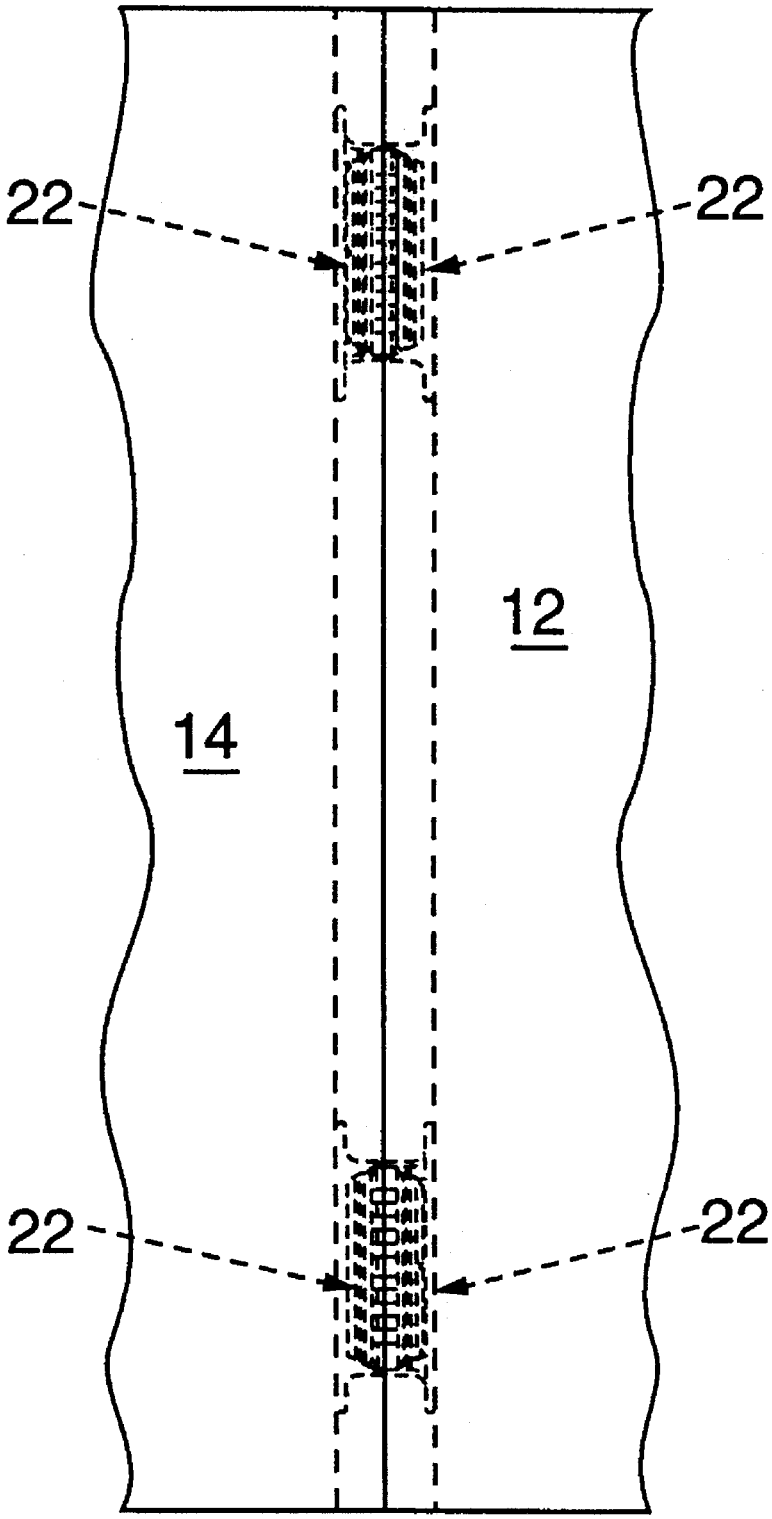
FIG. 16 is a front elevation view showing the panels in a fully engaged position.

In order to assemble panels 12 and 14, the panels are moved into position with their edges in abutment and with clips 22 adjacent each other (see FIGS. 14 and 15). With the edges still held together, the panels are slid against each other, thereby causing the clips to slide into position, nesting with one another (see FIGS. 14 and 15).

Chamfered edges 50 of clips 22, in combination with the triangular configuration of lower and upper linear members 36 and 38, cause the clips to be self-aligning to facilitate ease of assembly. Thus, as discussed above, if the clips are somewhat out of alignment, the sloping configuration of the various components will result in self-alignment. As the clips slide into a nesting position with respect to each other, the linear members slide into the slots provided in the adjacent clip. Thus, for example, lower linear member 36 slides into upper slot 37, upper linear member 38 slides into lower slot 39, and flange 40 slides into base slot 41. Strengthening webs 46 are configured such that their inclination further facilitates alignment of the clips. Raised portion 42 of lower linear member 36 is positioned in cut-out portion 44 to provide the desired nesting arrangement. With the clips nesting into one another as shown in FIG. 2, the upper portion of flange 40 is positioned immediately above strengthening ribs 28 of base portion 24.

FIG. 2 shows some spacing between the two clips when they are in an engaged position. This spacing can be varied, but it should be such that there is little possible movement between the panels when they are fully engaged. The configuration of the panel assembly system thus provides a relatively tight fit which will ensure that a full bleed display system is provided with the panels in direct abutment with one another, but one which does not really require resiliency of the clips in order to provide a tight fit and a solid mounting system.

In order to disassemble the unit, the panels are merely slid end to end with respect to each other until the clips become disengaged. Thus, the system is disassembled and ready for shipment or re-assembly.

Clips 22 can be made of a variety of materials. However, it is presently thought that the best material is polycarbonate. This material provides sufficient strength and rigidity with a limited amount of friction to hold the pieces in place without creating a problem during assembly. While the clips can be of a wide variety of lengths, it has been found that if the chips are, from end to end, approximately 3¼ inches, that is a suitable size.

Thus, the display system of the present invention provides a system which achieves many of the objects of the invention and which overcomes many of the drawbacks of the prior art. It should be understood that the invention is not restricted to the particular embodiment which has been described, since variations may be made without departing from the scope of the invention as defined in the claims.

It is claimed and desired to secure as Letters Patent:

1. A panel system in which adjacent panels are removably joined at their edges, comprising:

a pair of panels to be joined, each of the panel edges defining a channel having flat walls which extend parallel to their respective panel, from a channel bottom to the panel edge, a pair of substantially identical clips, each of which is affixed to an edge of a panel, each clip including a base portion and a body portion extending upwardly from the base portion in a generally perpendicular direction, at least two linear members extending in an inward direction away from the body portion and parallel to the base, the members defining at least two slots therebetween which also extend parallel to the base, the body portion further having a substantially flat, outwardly facing portion on the side of the body opposite from the members;

the base of each clip being affixed to its respective channel at the bottom thereof, with at least one of the members and at least one of the slots being disposed within the channel when the base is so mounted, and at least one of the members and at least one of the slots extending out of the channel beyond the edge of the panel when the base is so mounted, and with the flat, outwardly facing portion of the body of each clip extending in substantial contact with one of the channel walls, so that the clips and their associated panels can be mounted to one another by sliding the members of one of the clips into complementing slots in the other clip, with the channel walls preventing the two clips from being disengaged.

2. The panel system of claim 1, further comprising at least a third linear member extending in an inward direction away from the body portion and parallel to the base.

3. The panel system of claim 2 wherein two of the linear members which are more closely proximate the base of each of the clips are generally triangular in cross section.

4. The panel system of claim 3 wherein the third of the linear members, disposed remote from the base with respect to the other linear members, is in the form of a generally upwardly and inwardly extending flange, having an angularity which corresponds to the angularity of the linear members which are generally triangular in cross section.

5. The panel system of claim 4 wherein the generally triangular linear member which is most proximate to the base includes a raised portion facing the base, and the flange includes a corresponding cut-out portion so that when the clips of adjacent panels are fit together the raised portion nests into the cut-out portion.

6. The panel system of claim 3, further comprising a plurality of angular webs extending between the two generally triangular linear members and which further define one of the slots therebetween and enhance the stiffness of each clip.

7. A first clip which is designed for the removable assembly of the edges of a pair of panels, comprising a flat base portion, an upwardly extending body portion having an inwardly facing side and an outwardly facing side, the inwardly facing side including at least two linear members which are substantially triangular in cross section and which extend parallel to the base, and an inwardly and upwardly extending linear flange member disposed adjacent one of the substantially triangular linear members but remote from the base with respect to the triangular members, the triangular members and the flange defining therebetween a plurality of slots configured to receive corresponding linear members of an identical second clip which is nested with the first clip, the outwardly facing side of the body portion having a flat portion which extends substantially perpendicularly from the base portion.

* * * * *